US006444313B1

(12) United States Patent
Ono et al.

(10) Patent No.: US 6,444,313 B1
(45) Date of Patent: Sep. 3, 2002

(54) THERMOCHROMIC ACRYLIC SYNTHETIC FIBER, ITS PROCESSED ARTICLE, AND PROCESS FOR PRODUCING THERMOCHROMIC ACRYLIC SYNTHETIC FIBER

(75) Inventors: Yoshiaki Ono, Gifu; Naoya Ishimura, Oobu; Yutaka Shibahashi, Nagoya, all of (JP)

(73) Assignee: The Pilot Ink Co., Ltd., Aichi-ken (JP)

( * ) Notice: Subject to any disclaimer, the term of this patent is extended or adjusted under 35 U.S.C. 154(b) by 0 days.

(21) Appl. No.: 09/754,309

(22) Filed: Jan. 5, 2001

(51) Int. Cl.[7] ..... D01F 6/00

(52) U.S. Cl. ..... 428/372; 428/913; 428/402.2; 106/448; 106/11 A

(58) Field of Search ..... 428/372, 402.2, 428/915; 106/498, 21 A

(56) References Cited

U.S. PATENT DOCUMENTS

| | | | | |
|---|---|---|---|---|
| 3,410,819 A | | 11/1968 | Erdly et al. | |
| 3,852,401 A | | 12/1974 | Suzuki et al. | 264/182 |
| 4,028,118 A | * | 6/1977 | Nakasuji et al. | 106/21 |
| 4,732,810 A | * | 3/1988 | Kito et al. | 428/402.2 |
| 5,558,699 A | * | 9/1996 | Nakashima et al. | 106/21 A |
| 5,879,443 A | * | 3/1999 | Senga et al. | 106/498 |

FOREIGN PATENT DOCUMENTS

| | | |
|---|---|---|
| EP | 0 665 119 | 8/1995 |
| EP | 0 787 779 | 8/1997 |
| EP | 0 873 881 | 10/1998 |
| JP | 62149907 | 7/1987 |
| JP | 11-203581 | 7/1999 |
| JP | 11-230860 | 8/1999 |

* cited by examiner

*Primary Examiner*—N. Edwards
(74) *Attorney, Agent, or Firm*—Fitzpatrick, Cella, Harper & Scinto

(57) ABSTRACT

A thermochromic acrylic synthetic fiber comprising an acrylonitrile polymer in which a thermochromic pigment composition with an average particle diameter of from 0.5 $\mu$m to 30 $\mu$m is dispersedly contained in an amount of from 0.5% by weight to 40% by weight based on the weight of the polymer, and being made into fibers; the pigment composition containing (a) an electron-donating color-developing organic compound, (b) an electron-accepting compound and (c) a reaction medium that determines the temperature at which the color-developing reaction of the both compounds takes place.

Also disclosed are a processed article of the above thermochromic acrylic synthetic fiber, and a process for producing the thermochromic acrylic synthetic fiber.

8 Claims, 8 Drawing Sheets

THERMOCHROMIC ACRYLIC SYNTHETIC FIBER, ITS PROCESSED ARTICLE, AND PROCESS FOR PRODUCING THERMOCHROMIC ACRYLIC SYNTHETIC FIBER

The disclosures of Japanese Applications No. 11-203581 and No. 11-230860 are hereby incorporated by reference.

BACKGROUND OF THE INVENTION

1. Field of the Invention

This invention relates to a thermochromic acrylic synthetic fiber having a thermochromic pigment contained dispersedly in an acrylonitrile polymer, its processed article, and a process for producing the thermochromic acrylic synthetic fiber.

2. Related Background Art

As a means for providing fibers with a thermochromic function, conventionally available are a means of covering fiber surfaces with thermochromic layers having a thermochromic pigment fixed dispersedly in a binder resin (Japanese Patent Applications Laid-Open No. 61-179389, No. 62-156355, etc.) and a means of melt-blending a thermochromic pigment in a thermoplastic fiber-forming polymer such as polyester, polyamide or polyolefin, followed by melt-spinning to form fibers in an integral form.

Now, in the case of the acrylic synthetic fiber, fibers can not be formed by melt spinning, melt-blending the thermochromic pigment integrally, because of thermal properties of the acrylonitrile polymer. Accordingly, it has been indispensable to form on fiber surfaces the above thermochromic layers by post-processing to provide the thermochromic function.

Hence, it has been unavoidable that the feeling or hand of acrylic fibers themselves is damaged and besides, compared with those melt-spinned by melt blending, the products are inferior in respect of durability such as wash-fastness, rub strength and light fastness.

Meanwhile, in the case of those obtained by melt spinning, the thermochromic pigment undergoes high temperature and high pressure in the course of its melt-blending with the fiber-forming polymer and in the course of melt spinning. This causes thermal deterioration of the thermochromic pigment in some cases. Accordingly, there has been obstruction to the use of fiber-forming polymers having high molecular weight and high melting point which are commonly applicable to fibrous products, and it has been difficult to practically satisfy durability such as fiber strength.

SUMMARY OF THE INVENTION

The present inventors made extensive studies to eliminate the above difficulties. Accordingly, an object of the present invention is to provide a thermochromic acrylic synthetic fiber, and its processed article, which can effectively lastingly exhibit the thermochromic function without losing the hand inherent in acrylic fibers and other fibrous features, and to provide a process for producing such a thermochromic acrylic synthetic fiber.

To achieve the above object, the present invention provides a thermochromic acrylic synthetic fiber comprising an acrylonitrile polymer in which a thermochromic pigment composition with an average particle diameter of from 0.5 $\mu$m to 30 $\mu$m is dispersedly contained in an amount of from 0.5% by weight to 40% by weight based on the weight of the polymer, and being made into fibers; the pigment composition containing (a) an electron-donating color-developing organic compound, (b) an electron-accepting compound and (c) a reaction medium that determines the temperature at which the color-developing reaction of the both compounds takes place.

As a preferred embodiment of the above thermochromic acrylic synthetic fiber, the thermochromic pigment composition may have an average particle diameter [(length+breadth)/2] in the range of from 0.5 $\mu$m to 15.0 $\mu$m;

the thermochromic pigment composition may be a pigment composition having a microcapsular form in which a reversible thermochromic composition containing (a) the electron-donating color-developing organic compound, (b) the electron-accepting compound and (c) the reaction medium that determines the temperature at which the color-developing reaction of the both compounds takes place is enclosed in microcapsules;

the thermochromic pigment composition may be a thermochromic pigment composition having a microcapsular form of reversible thermochromic composition/wall film=7/1 to 1/1 (weight ratio);

the thermochromic pigment composition may have a non-round particle cross section; or the thermochromic pigment composition may be a pigment composition having a hollow at some part of a particle outer surface; or the thermochromic pigment composition may be a pigment composition selected from any one of a heat-color-extinguishing type capable of color-extinguishing upon heating from a color-developed state and developing a color upon cooling from a color-extinguished state, a color-memorizing type capable of memorizing a color-developed state and a color-extinguished state alternately in a specific temperature region, and a heat-color-developing type capable of developing a color upon heating from a color-extinguished state and restoring to the color-extinguished state upon temperature drop from a color-developed state.

The present invention also provides a fiber processed article comprising a plurality of filaments of long fibers or short fibers of the above thermochromic acrylic synthetic fiber, having a single-fiber external diameter of from 1 $\mu$m to 100 $\mu$m; the filaments being made into a bundled, close-contact or massed state.

The present invention still also provides a process for producing a thermochromic acrylic synthetic fiber, comprising the step of;

subjecting to wet spinning a spinning dope comprising a concentrated aqueous inorganic salt solution in which an acrylonitrile polymer has been dissolved and in which a thermochromic pigment composition with an average particle diameter of from 0.5 $\mu$m to 30 $\mu$m is dispersedly blended in an amount of from 0.5% by weight to 40% by weight based on the weight of the polymer; the pigment composition containing (a) an electron-donating color-developing organic compound, (b) an electron-accepting compound and (c) an reaction medium that determines the temperature at which the color-developing reaction of the both compounds takes place.

In the above process, the concentrated aqueous inorganic salt solution may contain as a chief component a thiocyanate or zinc chloride.

BRIEF DESCRIPTION OF THE DRAWINGS

FIG. 2A is an enlarged view of its appearance, and FIG. 2B, its cross section.

FIG. 3A is an enlarged view of its appearance, and FIG. 3B, its cross section.

FIG. 4A is an enlarged view of its appearance, and FIG. 4B, its cross section.

FIG. 5A is an enlarged view of its appearance, and FIG. 5B, its cross section.

DESCRIPTION OF THE PREFERRED EMBODIMENTS

Thermochromic Acrylic Synthetic Fiber

Figure 1:
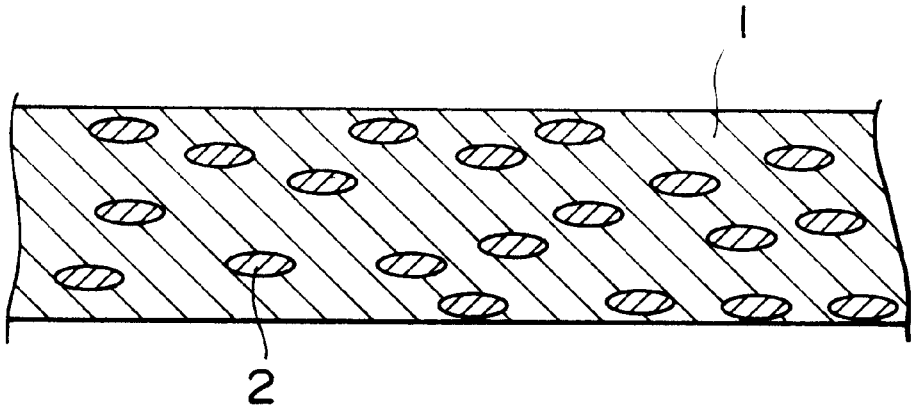
FIG. 1 is a cross-sectional illustration of the thermochromic acrylic synthetic fiber of the present invention.

The present invention is a thermochromic acrylic synthetic fiber comprising an acrylonitrile polymer 1 in which a thermochromic pigment composition 2 with an average particle diameter of from 0.5 $\mu$m to 30 $\mu$m is contained dispersedly as shown in FIG. 1, in an amount of from 0.5% by weight to 40% by weight based on the weight of the polymer, and being made into fibers. The pigment composition contains (a) an electron-donating color-developing organic compound, (b) an electron-accepting compound and (c) a reaction medium that determines the temperature at which the color-developing reaction of the both compounds takes place.

As the thermochromic pigment composition, it is effective to use a conventionally known pigment composition containing three essential components which are (a) the electron-donating color-developing organic compound, (b) the electron-accepting compound and (c) the reaction medium that determines the temperature at which the color-developing reaction of the both compounds takes place. Stated specifically, usable are those disclosed in U.S. Pat. Nos. 4,028,118 and 4,732,810.

Figure 6:
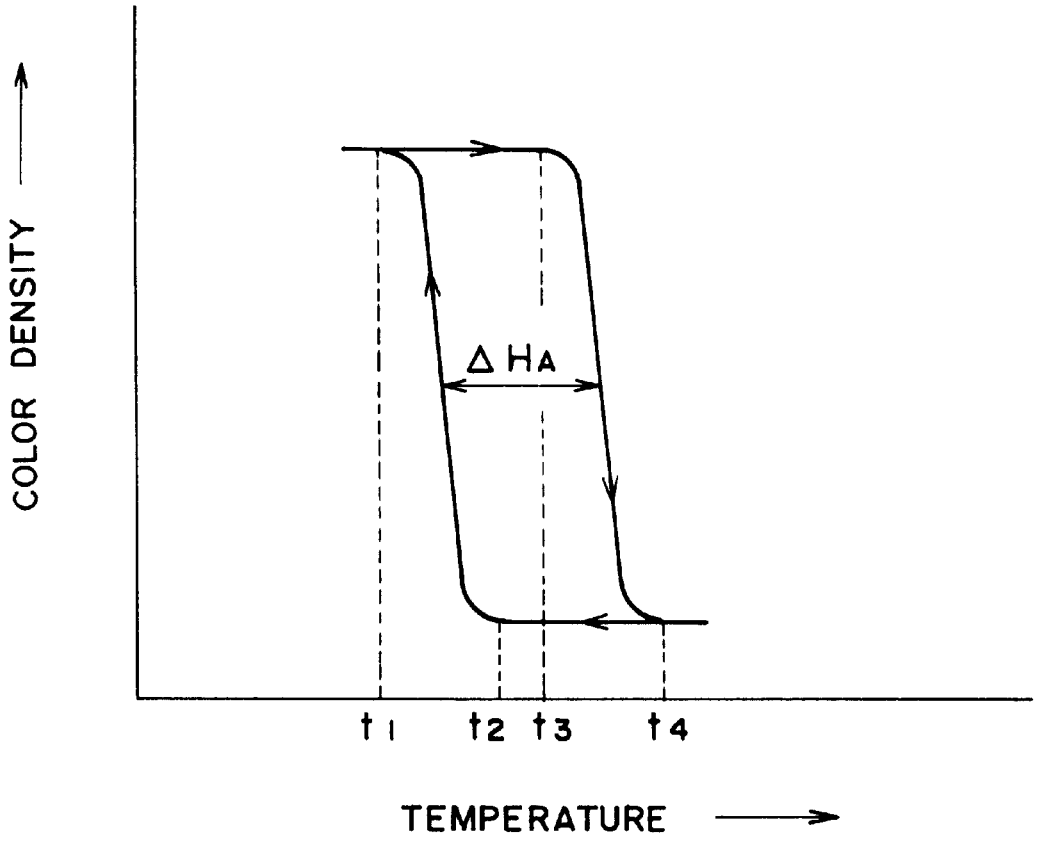
FIG. 6 is a graph showing metachromatic behavior of a heat-color-extinguishing thermochromic composition.

The above thermochromic pigment composition changes in color at about a given temperature (color-changing point) making a border, where it shows a color-extinguished state in the temperature region of the color-changing point and above and a color-developed state in the temperature region below the color-changing point, and in the normal temperature region can only exist in any one specific state of the both states. More specifically, it may include heat-color-extinguishing type thermochromic compositions (A) having properties of a relatively small hysteresis width ($\Delta H_A$=1 to 7° C.), in which the other state is maintained so long as the heat or cold that is required for coming into that state is applied, but returns to the state shown in the normal temperature region once the heat or cold comes not to be applied. In particular, those having a system with $\Delta H_A$ of 3° C. or below [which makes use as the component (c) an aliphatic ester showing a $\Delta T$ value (melting point-cloud point) of 3° C. or below as disclosed in U.S. Pat. No. 4,732,810] can sharply respond to temperature changes at the color-changing point making a border, to exhibit heat-color-extinguishing performance in a high sensitivity, and are effectively applicable according to purposes (see FIG. 6).

Figure 7:
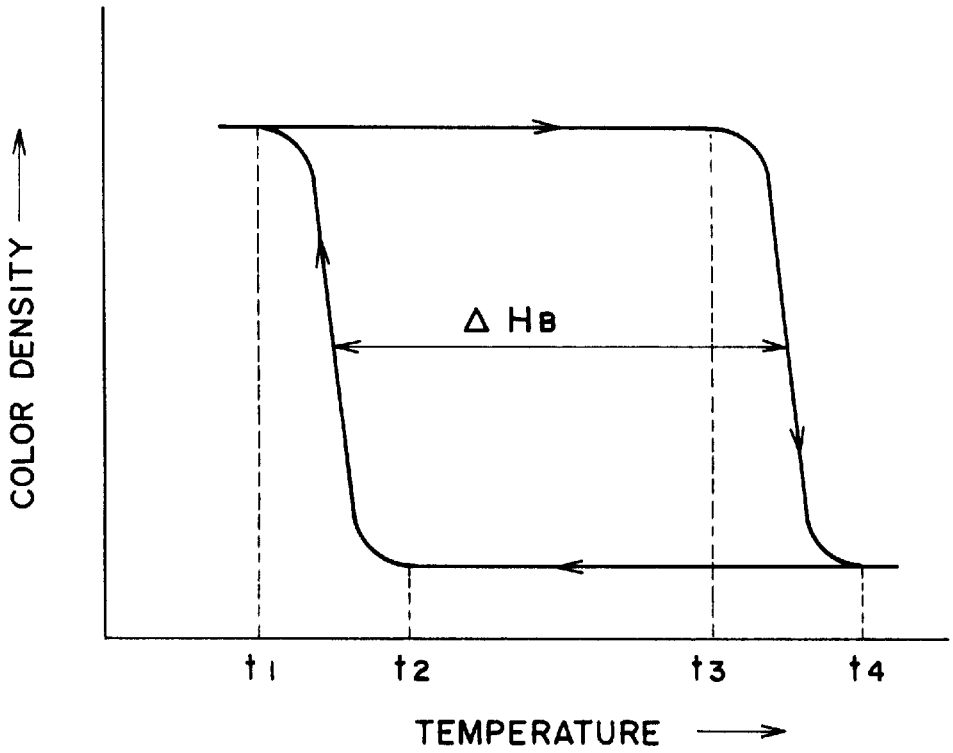
FIG. 7 is a graph showing metachromatic behavior of a color-memorizing thermochromic composition.

Also usable are those disclosed in U.S. Pat. Nos. 4,720,301, 5,558,699 and 5,879,443. These are color-memorizing type thermochromic compositions (B) showing great hysteresis characteristics ($\Delta H_B$=8 to 50° C.), i.e., those capable of changing in color following courses which are greatly different in shape of curves formed by plotting changes in coloring density due to changes in temperature, between a case where the temperature is raised from the side of a temperature lower than a color-changing temperature region and a case where inversely the temperature is dropped from the side of a temperature higher than the color-changing temperature region, and memorizing a color-developed state at a low-temperature region of t1 and below or a color-extinguished state at a high-temperature region of t4 and above in a specific temperature region [a temperature region between t2 and t3 (substantially two-phase holdable temperature region)] (see FIG. 7).

Incidentally, as the substantially two-phase holdable temperature region, a region embracing a normal temperature region (e.g., 15 to 35° C.) can be general-purpose, but it is by no means specified to such a temperature range.

Figure 8:
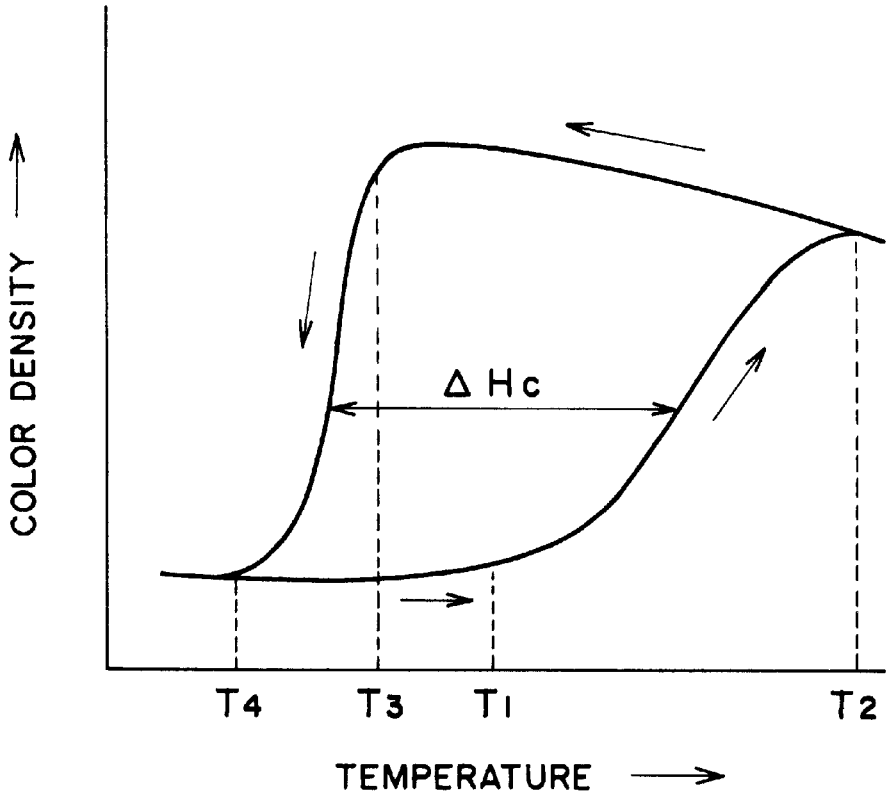
FIG. 8 is a graph showing metachromatic behavior of a heat-color-developing thermochromic composition.

The thermochromic pigment composition may also include, as heat-color-developing type thermochromic compositions (C), which are capable of developing a color upon heating from the color-extinguished state, those disclosed in Japanese Pat. Applications Laid-Open No. 11-129623 and No. 11-5973, in which a specific alkoxyphenolic compound having a straight-chain or side-chain alkyl group having 3 to 18 carbon atoms is used as the component-(b) electron-accepting compound (see FIG. 8).

A pigment composition comprising any of the above three types (A, B and C) of thermochromic compositions may be used under appropriate selection according to purposes, thus a thermochromic acrylic synthetic fiber can be provided which has various forms of color changes.

The thermochromic pigment composition may be in the form of fine particles containing the above three components (a), (b) and (c), and may effectively be a particulate composition produced by blending the three components with a binder resin (such as a thermosetting epoxy resin containing a curing agent), a composition obtained by further coating such a particulate composition with a different resin (such as a water-soluble polymeric compound such as a polyvinyl alcohol resin), or a composition having a microcapsular form in which the above three components (a), (b) and (c) are enclosed in microcapsules having wall films (such as a thermosetting resin including, e.g., bisphenol-A type epoxy resins, novolak type epoxy resins and polyurethane resins (reaction products of aromatic isocyanate prepolymers with polyhydroxyl compounds)). In particular, those having the microcapsular form are preferred in view of sharp color-developing performance, high coloring density, homogeneity, dispersion stability, resistance to chemicals, and so forth.

The thermochromic pigment composition may have an average particle diameter [(length+breadth)/2] in the range of from 0.5 $\mu$m to 30 $\mu$m, preferably from 0.5 $\mu$m to 15 $\mu$m, and more preferably from 0.5 μm to 10 μm. This is effective in view of sharpness in metachromatism, durability, processing suitability and so forth.

In a system having an average particle diameter larger than 30 μm, the pigment composition may non-homogeneously be dispersed to make it difficult to form fibers capable of showing thermochromic performance in a stable quality. In a system having an average particle diameter smaller than 30 μm, especially in the system of the pigment composition having a microcapsular form, although a thermochromic pigment composition made into microcapsules in a state suspended in an aqueous medium can be obtained, there is a difficulty in separation of the encapsulated pigment composition therefrom by a means such as filtration or centrifugation, and also an insufficient strength may result.

In the case of the pigment composition having a microcapsular form, those having a round particle cross section may be used without prohibition. However, effectively usable are those having a non-round particle cross section, stated specifically, non-spherical thermochromic pigment compositions having a hollow at least at some part of a particle outer surface (see FIGS. 2 to 5).

Such a thermochromic pigment composition is a pigment composition having a non-spherical form and a flat particle shape, and hence can appropriately undergo elastic deformation to relieve stress, against any load caused by pressure or heat, bringing about the effect of keeping capsule wall films from breaking. More specifically, in the course of heating, wall films undergo elastic deformation in accordance with thermal expansion and constriction of capsules to bring about the effect of keeping capsule wall films from breaking, and function effectively as a thermochromic pigment composition having a microcapsular form which is tough enough to protect the reversible thermochromic composition enclosed therein and make it retain the intended thermochromic function.

In the thermochromic pigment composition made into microcapsules according to the present invention, the proportion of the reversible thermochromic composition to wall film in each capsule, i.e., reversible thermochromic composition/wall film may preferably be in the range of 7/1 to 1/1 (weight ratio). If the reversible thermochromic composition is in a proportion beyond the above range, the wall film may have so small a thickness as to have a low function of protecting the reversible thermochromic composition enclosed therein. If on the other hand the wall film is in a proportion beyond the above range, a low coloring density may inevitably result, undesirably.

As a means by which the reversible thermochromic composition is enclosed in microcapsules, any known encapsulation process may be used, as exemplified by interfacial polymerization, interfacial polycondensation, in-situ encapsulation, or coacervation. In order to obtain the thermochromic pigment composition of the present invention, having the particle diameter range and external particle shape that satisfy the requirements described above, interfacial polymerization or interfacial polycondensation is preferred, which may hardly cause agglomeration and coalescence. Also, after encapsulation has been completed, the resultant capsule suspension may optionally be diluted with water, and impurities and coarse particles may be filtered off by means of a filter to remove unwanted impurities and coarse particles.

The thermochromic pigment composition may be blended in a proportion of from 0.5% by weight to 40% by weight based on the weight of the acrylonitrile polymer that forms fibers. If it is less than 0.5% by weight, the resultant product can not exhibit any sharp thermochromic performance. If on the other hand it is more than 40% by weight, the resultant product tends to cause color ghost at the time of color extinguishing. It may preferably be in the range of from 1% by weight to 20% by weight.

Fiber Processed Article

The thermochromic acrylic synthetic fiber processed article of the present invention comprises a plurality of filaments of long fibers or short fibers of the thermochromic acrylic synthetic fiber described above, having a single-fiber external diameter of from 1 μm to 100 μm; the filaments being made into a bundled, close-contact or massed state.

The fiber processed article may have a sized form such as tow, a sliver, or a cottony aggregate produced by aggregating staple fibers, a fiber-to-fiber close contact form such as yarn or cloth, or a massed form such as flocked fabric, raised fabric or papermaked fabric.

The yarn may include filament yarn, spun yarn and wool-yarn-like crimped yarn. Here, the filament yarn includes filament textured yarn subjected to stretch or bulky texturing. The spun yarn includes bulky yarn produced by spinning a blend of hot drawn staple fibers and hot non-drawn staple fibers.

The cloth may include woven fabric, knitted fabric, nonwoven fabric and pile fabric. The woven fabric may be exemplified by plain-weave fabric, twill weave (or twill) fabric, satin weave fabric, double warp fabric, double weft fabric, double warp-weft fabric, pile weave fabric, leno weave fabric and Jacquard fabric. The knitted fabric may also be exemplified by warp knitted fabric, weft knitted fabric, and lace.

The fiber processed article of the present invention can be obtained by processing the component thermochromic acrylic synthetic fiber by a conventional general-purpose processing means into the various forms described above. However, without any particular limitation to the above forms, any forms are effective as long as a plurality of filaments of the above fibers are made into the bundled, close-contact or massed state.

The fiber processed article of the present invention is a fiber processed article constituted as described above, and hence responds sharply to temperature changes to undergo a change in color, depending on the extent of uncovered outer surfaces of individual fibers. Moreover, since the fiber-forming acrylonitrile polymer capable of forming general-purpose acrylic synthetic fiber is used and besides the thermochromic pigment composition is dispersedly contained in the fiber, the fiber has the same durability and fibrous properties as those of general-purpose fibers. Accordingly, fiber processed articles having the same forms as those of general-purpose fibers as described above can be obtained, and can be used in knitted products as exemplified by various types of sweaters, polo shirts, sport shirts, cloth (dress material), underwears, pajamas, tights, gloves and stockings or socks, and textiles as exemplified by blankets, child's cloth (dress material), sport shirts and coats, as well as carpets, chair-covering cloth, curtains and so forth.

The fiber processed article of the present invention can further be used in wigs, hairpieces or doles' or animal toys' hair of the head, hair of bodies and outer garments part or the whole of which is formed of filament yarn, spun yarn, wool-yarn-like crimped yarn or pile fabric; and doles' or animal toys' clothes, outer garments or accessories constituted of any of woven fabric, knitted fabric, nonwoven fabric and pile fabric.

The fiber processed article may also be blended with a non-thermochromic fiber in an amount of from 0.01 part by weight to 20 parts by weight (usually from 5 to 15 parts by weight) based on 1 part by weight of the thermochromic acrylic synthetic fiber. Such a non-thermochromic fiber is blended in order to regulate glossiness or drape and to regulate the thermochromic effect. Without limitation to acrylic fibers, general-purpose common fibers are effective.

Production Process

A process for producing the thermochromic acrylic synthetic fiber according to the present invention is described below.

The production process of the present invention comprises the step of;

subjecting to wet spinning a spinning dope comprising a concentrated aqueous inorganic salt solution in which an acrylonitrile polymer has been dissolved and in which a thermochromic pigment composition with an average particle diameter of from 0.5 μm to 30 μm is dispersedly blended in an amount of from 0.5% by weight to 40% by weight based on the weight of the polymer; the pigment composition containing (a) an electron-donating color-developing organic compound, (b) an electron-accepting compound and (c) an reaction medium that determines the temperature at which the color-developing reaction of the both compounds takes place.

In the above process, the concentrated aqueous inorganic salt solution may include concentrated aqueous solutions of thiocyanates such as sodium thiocyanate, potassium thiocyanate, ammonium thiocyanate and calcium thiocyanate, and concentrated aqueous solutions of inorganic salts such as zinc chloride and lithium chloride. These inorganic salts act as good solvents of the acrylonitrile polymer without causing any deterioration of metachromatic function of the thermochromic pigment composition. Also, as a coagulating bath in which filamentous material ejected from a spinning nozzle is made to coagulate, preferred is water or an aqueous solution of the above inorganic salts in a concentration of 20% or less which is conventionally in general use.

With regard to the spinning dope, its mixing quantity may be regulated in accordance with the degree of polymerization of the above polymer so as to provide a spinning dope having appropriate properties. Usually, those having a viscosity of about 40 to 200 poises at 30° C. are effective.

The acrylonitrile polymer may include those containing i) polyacrylonitrile or a copolymer of acrylonitrile with a compound copolymerizable therewith and ii) a second component such as vinyl chloride. Preferred are those containing acrylonitrile in an amount of 50% by weight or more, and preferably 80% by weight or more. As the compound copolymerizable with acrylonitrile to produce an acrylonitrile copolymerization product effective for practicing the present invention, it may include, but not particularly limited to, e.g., acrylic acid or methacrylic acid esters such as methyl acrylate, ethyl acrylate and methyl methacrylate; acrylamide, methacrylamide, and alkyl-substituted products or nitrogen substituted products of these; vinyl pyridines such as 2-vinyl pyridine and 2-methyl-5-vinyl pyridine; styrene and alkyl-substituted products thereof; and also monomers such as vinyl chloride, vinylidene chloride, vinyl bromide and vinylidene bromide.

The single-polymer acrylonitrile or copolymer acrylonitrile may usually have a molecular weight (average molecular weight) appropriately selected within the range of from 15,000 to 150,000 (for general purpose, from 25,000 to 800,000).

The spinning dope in the present invention may be composed of from 5 to 30% by weight (preferably from about 10 to 20% by weight) of the acrylonitrile polymer and from 30 to 60% by weight of the thiocyanate or zinc chloride. In such a spinning dope, the thermochromic pigment composition may be dispersed in an amount of from 0.5 to 40% by weight (preferably from 1 to 20% by weight) based on the weight of the polymer. Any of commonly available pigments and lustrous materials may further be added.

The above spinning dope may be extruded at 45° C. to 75° C. from a spinning nozzle into the coagulating bath such as a dilute aqueous thiocyanate solution to cause it to coagulate, followed by known steps of washing with water, heat treatment, drying, and further crimping treatment, lubricant treatment and so forth to produce the fiber.

In the system in which the pigment composition having a microcapsular form is used as the thermochromic pigment composition, the pigment composition has a durability and also is readily dispersible at the time the spinning dope is prepared. In particular, the pigment composition having a non-round particle cross section can relieve stress because of its own elastic deformation, against any load caused by pressure or high-temperature heat in the course of spinning and in the course of the formation of fibers by drawing. In addition, in company with the properties that the microcapsular pigment composition itself tends to be oriented in the lengthwise direction at the time of fiber formation, the microcapsules by no means break. Thus, the fiber that satisfies the intended thermochromic function can be obtained.

The single fiber in the present invention may have a fiber diameter of from 1 μm to 100 μm (preferably from 10 μm to 40 μm). The fiber may be treated in the same way as general-purpose non-thermochromic acrylic fibers so as to be made into tow, staple fibers and any other desired fibrous form, and may be put into practical use.

In a fiber diameter smaller than 1 μm, the fiber can not have a proper fibrous form in relation to the particle diameter of the thermochromic pigment composition and the spinning properties. On the other hand, in a fiber diameter larger than 100 μm, the fiber may show a property of rigid filaments and may satisfy fibrous properties with difficulty.

Here, the single fiber may have any external shape without limitation to a round shape, and may have a flat shape, a polygonal shape or any other known irregular shape.

Incidentally, to attain a fiber diameter of 30 μm or smaller in the wet spinning described above, the fiber can continuously and stably be formed when a relationship of $d<D\leqq d$ (wherein d represents particle diameter of the pigment composition, and D, fiber diameter) is satisfied.

The thermochromic acrylic synthetic fiber of the present invention can be obtained using the spinning dope in which the thermochromic pigment composition having a specific particle diameter has been dispersed in a specific quantity in the concentrated aqueous inorganic salt solution containing the acrylonitrile polymer, and by ejecting the spinning dope from a spinning nozzle into the coagulating bath, followed by post treatment such as drawing by any known means so as to be made into a fibrous form. The single fibers thus obtained are put into practical use in the form of various fiber processed articles made into a bundled, close-contact or massed state. Examples of the fiber processed article are as described previously, but in the present invention by no means limited thereto, and those satisfying the above state are effective.

The present invention will be described below in greater detail by giving Examples.

In Examples given below, as the form of the pigment composition having a microcapsular form, forms as exemplified in FIGS. 2 to 5 are used, but a combined form of these forms or a round cross-sectional form may also be used. The present invention is by no means limited to these examples.

In the following Examples, "part(s)" refers to "part(s) by weight".

EXAMPLE 1

10 parts of an acrylonitrile copolymer obtained by polymerization under monomer composition of 90 parts of acrylonitrile, 9.8 parts of methyl acrylate and 0.2 part of sodium metasulfonate was dissolved in 89 parts of an aqueous sodium thiocyanate solution of 50% by weight in concentration to obtain an acrylonitrile copolymer solution.

Figure 2A:
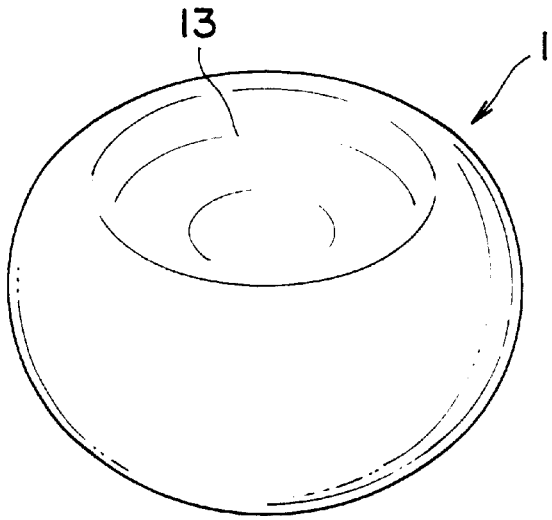
FIGS. 2A and 2B show an example of the thermochromic pigment composition applied in the thermochromic acrylic synthetic fiber of the present invention.
Figure 2B:
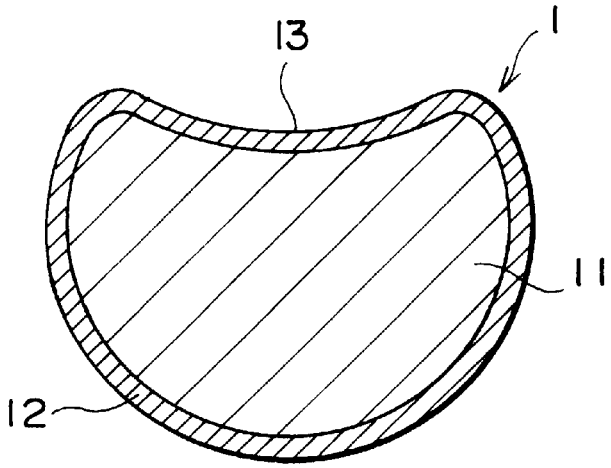

In 99 parts of the acrylonitrile copolymer solution, 1 part of a reversible thermochromic pigment composition (color-extinguishing temperature t4: about 33° C.; color-developing temperature t1: about 28° C.; blue in the color-developed state and colorless in the color-extinguished state; average particle diameter: 3 μm; particle cross-sectional shape: as shown in FIGS. 2A and 2B; reversible thermochromic composition/wall film=5.6/1.0) having a reversible thermochromic composition enclosed in microcapsules formed of epoxy resin wall films; the reversible thermochromic composition being comprised of 1 part of (a) 3-(2-ethoxy-4-diethylaminophenyl)-3-(1-ethyl-2-methyl indol-3-yl)4-azaphthalide, 5 parts of (b) 1,1-bis(4-hydroxyphenyl)-2-methylpropane, 25 parts of (c) cetyl alcohol and 25 parts of stearyl caprate. The mixture obtained was uniformly dispersed to prepare a spinning dope comprised of 1% by weight of the reversible thermochromic pigment composition, 10% by weight of the acrylonitrile copolymer, 44.5% by weight of sodium thiocyanate and 44.5% by weight of water.

The spinning dope was ejected at −2° C. into an aqueous sodium thiocyanate solution of 15% by weight in concentration from a spinning nozzle of 0.04 mm in aperture diameter to carry out wet spinning, further followed by washing with water, drawing, drying densification, crimping treatment, heat treatment, lubricant treatment and so forth under conventionally known conditions to obtain a thermochromic acrylic synthetic fiber having a fiber diameter of 20 μm.

This fiber had a heat-color-extinguishing thermochromic performance (see FIG. 6), which stood blue at room temperature (25° C.), and turned colorless upon heating to a temperature of about 33° C. or above. In this state the fiber was left at room temperature (25° C.), whereupon it again became blue at about 28° C.

This metachromatism was repeatable.

EXAMPLE 2

10 parts of an acrylonitrile copolymer obtained by polymerization under monomer composition of 88 parts of acrylonitrile and 12 parts of methyl acrylate was dissolved in 89 parts of an aqueous zinc chloride solution of 60% by weight in concentration to obtain an acrylonitrile copolymer solution.

Figure 3A:
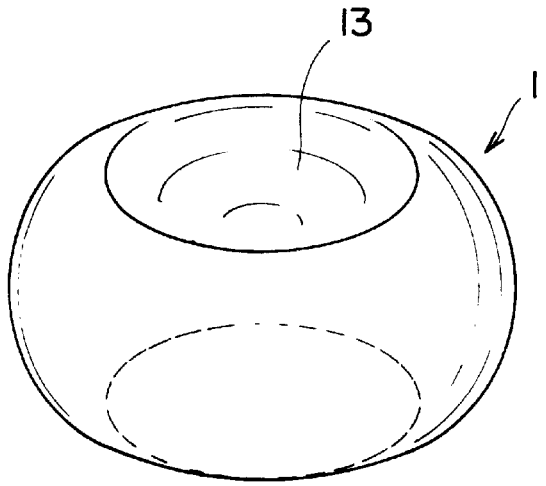
FIGS. 3A and 3B show another example of the thermochromic pigment composition applied in the thermochromic acrylic synthetic fiber of the present invention.
Figure 3B:
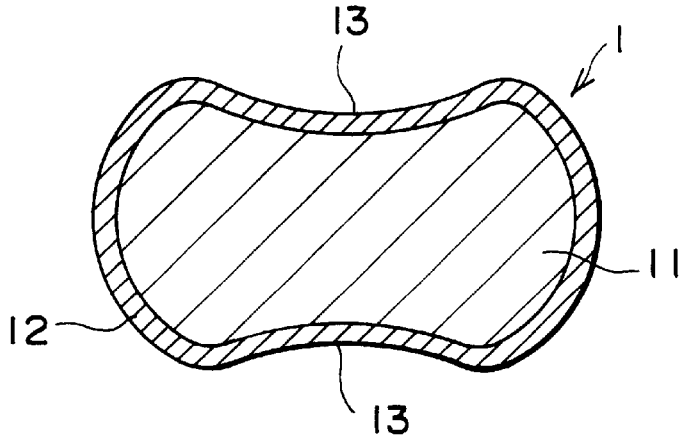

In 99 parts of the acrylonitrile copolymer solution, 1 part of a reversible thermochromic pigment composition (color-extinguishing temperature t4: about 15° C.; color-developing temperature t1: about 10° C.; pink in the color-developed state and colorless in the color-extinguished state; average particle diameter: 5 μm; particle cross-sectional shape: as shown in FIGS. 3A and 3B; reversible thermochromic composition/wall film=5.8/1.0) having a reversible thermochromic composition enclosed in microcapsules formed of epoxy resin wall films; the reversible thermochromic composition being comprised of 3 part of (a) 1,2-benzo-6-diethylaminofluorane, 5 parts of (b) 2,2-bis(4-hydroxyphenyl)propane, 25 parts of (c) myristyl alcohol and 25 parts of decyl myristate. The mixture obtained was uniformly dispersed to prepare a spinning dope comprised of 1% by weight of the reversible thermochromic pigment composition, 10% by weight of the acrylonitrile copolymer, 53.4% by weight of zinc chloride and 35.6% by weight of water.

The spinning dope was ejected at −2° C. into an aqueous zinc chloride solution of 15% by weight in concentration from a spinning nozzle of 0.06 mm in aperture diameter to carry out wet spinning, further followed by washing with water, drawing, drying densification, crimping treatment, heat treatment, lubricant treatment and so forth under conventionally known conditions to obtain a thermochromic acrylic synthetic fiber having a fiber diameter of 30 μm.

This fiber had a heat-color-extinguishing thermochromic performance (see FIG. 6), which stood colorless at room temperature (25° C.), and turned pink upon cooling to a temperature of about 10° C. or below. In this state the fiber was left at room temperature (25° C.), whereupon it again became colorless at about 15° C.

This metachromatism was repeatable.

EXAMPLE 3

10 parts of an acrylonitrile copolymer obtained by polymerization under monomer composition of 91 parts of acrylonitrile, 6.5 parts of methyl acrylate and 2.5 parts of N-methylolacrylamide was dissolved in 89 parts of an aqueous sodium thiocyanate solution of 50% by weight in concentration to obtain an acrylonitrile copolymer solution.

Figure 4A:
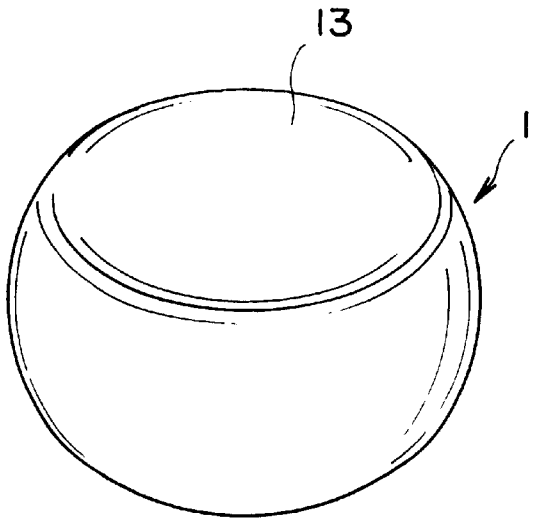
FIGS. 4A and 4B show still another example of the thermochromic pigment composition applied in the thermochromic acrylic synthetic fiber of the present invention.
Figure 4B:
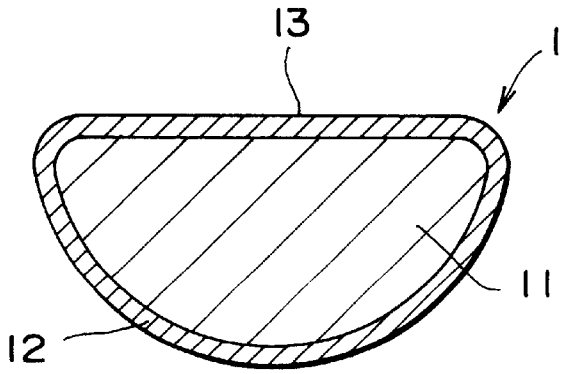

In 99 parts of the acrylonitrile copolymer solution, 1 part of a reversible thermochromic color-memorizing pigment composition (color-extinguishing temperature t4: about 32° C.; color-developing temperature t1: about 15° C.; orange in the color-developed state and colorless in the color-extinguished state; average particle diameter: 2 μm; particle cross-sectional shape: as shown in FIGS. 4A and 4B; reversible thermochromic composition/wall film=5.8/1.0) having a reversible thermochromic composition enclosed in microcapsules formed of epoxy resin wall films; the reversible thermochromic composition being comprised of 3 parts of (a) 1,3-dimethyl-6-diethylaminofluorane, 5 parts of (b) 1,1-bis(4-hydroxyphenyl)-2-ethylhexane and 50 parts of (c) neopentyl stearate. The mixture obtained was uniformly dispersed to prepare a spinning dope comprised of 1% by weight of the reversible thermochromic color-memorizing pigment composition, 10% by weight of the acrylonitrile copolymer, 44.5% by weight of sodium thiocyanate and 44.5% by weight of water.

The spinning dope was ejected at −2° C. into an aqueous sodium thiocyanate solution of 15% by weight in concentration from a spinning nozzle of 0.04 mm in aperture diameter to carry out wet spinning, further followed by washing with water, drawing, drying densification, crimping treatment, heat treatment, lubricant treatment and so forth under conventionally known conditions to obtain a thermochromic acrylic synthetic fiber having a fiber diameter of 15 μm.

This fiber, kept in the color-extinguished state at room temperature (25° C.), was cooled to about 15° C. or below, whereupon it colored in orange, and this color-developed state was retainable also when again heated to room temperature (25° C.). Also, when heated from the orange-color-developed state, the fiber came into the color-extinguished state at about 32° C., and this state was retainable until it was again cooled to about 15° C. or below, showing a color-memorizing thermochromic performance (see FIG. 7).

Thus, the fiber had a color-memorizing performance, and this metachromatism was repeatable.

EXAMPLE 4

To 100 parts of the spinning dope as used in Example 1, 0.05 part of an aqueous pink pigment dispersion (trade name: SANDYE SUPER PINK F5B; pigment content: about 14% by weight; available from Sanyo Color Works, Ltd.) was added, followed by uniform dispersion to obtain a spinning dope, which was then ejected at −2° C. into an aqueous sodium thiocyanate solution of 15% by weight in concentration from a spinning nozzle of 0.04 mm in aperture diameter to carry out wet spinning, further followed by washing with water, drawing, drying densification, crimping treatment, heat treatment, lubricant treatment and so forth under conventionally known conditions to obtain a thermochromic acrylic synthetic fiber having a fiber diameter of 20 μm.

This fiber stood purple at room temperature (25° C.), and turned pink upon heating to about 33° C. or above. In this state the fiber was left at room temperature (25° C.), whereupon it again became purple at about 28° C.

This metachromatism was repeatable.

EXAMPLE 5

Figure 5A:
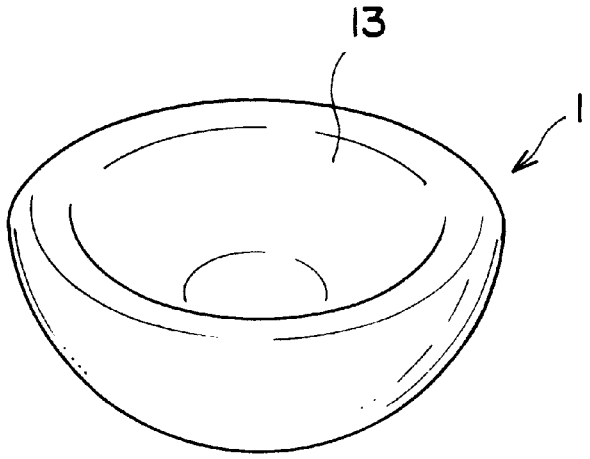
FIGS. 5A and 5B show a further example of the thermochromic pigment composition applied in the thermochromic acrylic synthetic fiber of the present invention.
Figure 5B:
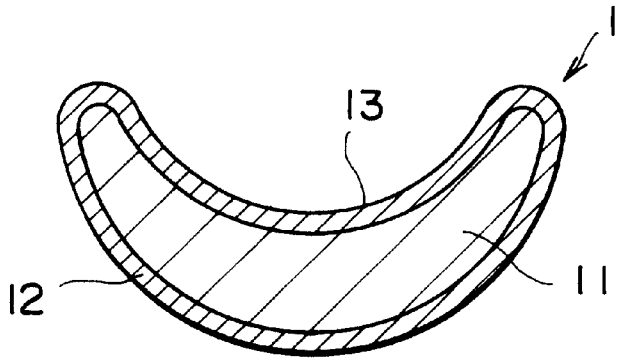

A thermochromic pigment composition (average particle diameter: 3 μm; particle cross-sectional shape: as shown in FIGS. 5A and 5B; reversible thermochromic composition/wall film=2.8/1.0) was obtained in the same manner as in Example 1 except that 1.5 parts of (a) 3-[2-ethoxy-4-(N-ethylanilino)phenyl)-3-(1-ethyl-2-methylindol-3-yl)4-azaphthalide, 6.0 parts and 4.0 parts of (b) p-n-nonyloxyphenol and p-n-octyloxyphenol, respectively, and 30.0 parts of (c) n-docosane were used in place of the components (a), (b) and (c) in Example 1. Subsequent procedure in Example 1 was also repeated to obtain a thermochromic acrylic synthetic fiber.

The above thermochromic pigment composition had a heat-color-developing thermochromic performance (see FIG. 8), which was in the color-extinguished state (colorless) at room temperature of 25° C., began to develop a color at about 33° C. (T1), came into a blue-color-developed state at 43° C. (T2) and then, in the course of temperature drop, maintained the color-developed state until 32° C. (T3), became color-extinguished little by little with a drop of temperature, and completely came into the color-extinguished state at 27° C. (T4), and the resultant fiber had the corresponding thermochromic performance.

This metachromatism was repeatable.

EXAMPLE 6

The fibers of Examples 1 to 5 were each cut on the bias in a length of from 100 mm to 150 mm to obtain five kinds of thermochromic raw cotton materials. The thermochromic raw cotton materials showed the same metachromatic behavior as the fibers of Examples 1 to 5. The raw cotton materials obtained by cutting on the bias were obtained using a means conventionally in general use. Fiber processed articles in the following Examples 7 to 12 were also obtained using a means conventionally in general use.

EXAMPLE 7

The thermochromic raw cotton materials in Example 6 were each set on a card machine and made into a sliver, followed by spinning to obtain five kinds of thermochromic spun yarn. The respective thermochromic spun yarn showed the same metachromatic behavior as the corresponding fibers of Examples 1 to 5.

EXAMPLE 8

With regard to the fibers of Examples 1 to 5, 30 single fibers having been crimped were each twisted thirty-five times per meter in a bundled state and made into filament yarn. Thereafter, this was woven by means of a knitting machine to obtain five kinds of thermochromic plain-weave fabrics. These thermochromic plain-weave fabrics showed the same metachromatic behavior as the corresponding fibers of Examples 1 to 5.

EXAMPLE 9

With regard to the fibers of Examples 1 to 5, raw cotton materials obtained by cutting on the bias in a length of from 80 mm to 130 mm were each set on a card machine and made into a sliver, followed by spinning to obtain spun yarn. This was woven by means of a knitting machine to obtain five kinds of thermochromic satin-weave fabrics. These thermochromic satin-weave fabrics showed the same metachromatic behavior as the corresponding fibers of Examples 1 to 5.

EXAMPLE 10

With regard to the fibers of Examples 1 to 5, webs were formed by means of a card machine. Four sheets of the webs were superposed, and immersed in an SBR resin emulsion, followed by squeezing with rolls and then drying to obtain five kinds of thermochromic nonwoven fabrics. These thermochromic nonwoven fabrics showed the same metachromatic behavior as the corresponding fibers of Examples 1 to 5.

EXAMPLE 11

Each spun yarn of Example 7 was woven into a circular knit by means of a knitting machine to obtain five kinds of thermochromic circular knitted fabrics. These thermochromic circular knitted fabrics showed the same metachromatic behavior as the corresponding spun yarn.

EXAMPLE 12

Each spun yarn of Example 7 was woven into towel fabric by means of a knitting machine to obtain five kinds of thermochromic towel fabrics. These thermochromic towel fabrics showed the same metachromatic behavior as the corresponding spun yarn.

EXAMPLE 13

With regard to the fibers of Examples 1 to 5, the fibers were each cut in a length of 3 mm to form pile for flocking, followed by electrostatic flocking by a conventional method to obtain five kinds of thermochromic flocked fabrics. These thermochromic flocked fabrics showed the same metachromatic behavior as the corresponding fibers of Examples 1 to 5.

EXAMPLE 14

The raw cotton materials in Example 6 were each set on a card machine and made into a sliver. Thereafter, this was stitched by means of a high-pile stitching machine to obtain five kinds of thermochromic high-pile fabrics of 30 mm in pile length. These thermochromic high-pile fabrics showed the same metachromatic behavior as the corresponding row cotton materials.

EXAMPLE 15

The thermochromic satin-weave fabrics of Example 9 were sewed to obtain five kinds of stuffed toys.

EXAMPLE 16

The thermochromic high-pile fabrics of Example 14 were sewed to obtain five kinds of stuffed toys.

EXAMPLE 17

With regard to the fibers of Examples 1 to 5, thermochromic raw cotton materials obtained by cutting on the bias in a length of from 80 mm to 130 mm, having been crimped, were each set on a card machine, followed by twisting by a conventional method to obtain bulky yarn. Three strands of this bulky yarn were bundled, and then twisted to obtain five kinds of thermochromic woolen yarn.

The thermochromic woolen yarn was cut in appropriate dimensions, and ends were bonded to obtain thermochromic artificial hairs. These artificial hairs showed the same metachromatic behavior as the corresponding fibers.

EXAMPLE 18

Knitted pile fabrics of 15 mm in pile length, obtained using the fibers of Examples 1 to 5, were subjected to blooming to obtain five kinds of thermochromic pile fabrics. These were bonded to the heads of dolls to obtain thermochromic artificial hairs. These artificial hairs showed the same metachromatic behavior as the corresponding fibers.

As described above, the thermochromic acrylic synthetic fiber of the present invention contains the thermochromic pigment composition having a specific particle diameter, standing dispersed in the fiber in a specific quantity, and hence, compared with a system in which the thermochromic pigment composition is fixed with a binder resin on the surface, can satisfy durability such as wash-fastness, scratch resistance or light-fastness and also does not damage the drape, bulkiness and other fibrous properties that are inherent in acrylic fibers.

The fiber processed article constituted of many single fibers made into the bundled, close-contact or massed state is also endowed with the thermochromic function without damaging the fibrous properties and processing suitability that are inherent in acrylic fibers, and moreover can effectively exhibit the thermochromic function.

Accordingly, as forms of yarn, the fiber processed article of the present invention can be effective as yarn for weaving (warp yarn and weft yarn), for knitting (knitting raw yarn and yarn for knitting by hand), for sewing (sewing yarn, yarn for sewing by hand, tacking thread and so forth), and for handicraft (lace yarn, embroider thread, lace raw yarn and so forth), and besides as yarn for industrial use. Also, in the forms of woven fabric, knitted fabric, nonwoven fabric and pile fabric, the fiber processed article can effectively be used in the field of, e.g., articles of clothing, articles of bedding, articles of accessories and articles of the interior as a matter of course, and also in the field of, e.g., artificial hair and stuffed toys.

In the system in which the pigment composition having a microcapsular form is used as the thermochromic pigment composition, it has a durability and also a good dispersibility when the spinning dope is prepared, and can further be effective in the courses of spinning and heat treatment. Especially in the system in which it has non-round particle cross section, it is rich in elastic deformation due to external pressure, and can relieve stress because of its own elastic deformation, against any load caused by pressure in the step of blending and pressure in the step of forming fibers. In addition, in company with the properties that the microcapsular pigment composition itself tends to be oriented in the lengthwise direction at the time of fiber formation, there is no possibility that the microcapsules are broken. Thus, the fiber that can effectively exhibit the intended thermochromic function without damaging it can be obtained, making it possible to provide a thermochromic acrylic synthetic fiber processed article which shows the same durability as the above also against any load caused by the heat and pressure in the course of secondary processing or in actual service and can make the thermochromic function last long.

What is claimed is:

1. A thermochromic acrylic comprising:

an acrylonitrile polymer having thermochrornic microcapsules dispersed therein, said thermochromic microcapsules having a non-round particle cross-section and an average particle diameter of from 0.5 $\mu$m to 30 $\mu$m;

said thermochromic microcapsules containing a reversible thermochromic pigment composition comprising (a) an electron-donating color-developing organic compound, (b) an electron-accepting compound and (c) a reaction medium affecting the temperature at which the color-developing reaction of the both compounds takes place;

said thermochromic microcapsules having a hollow at a portion of their particle outer surface and having a weight ratio of reversible thermochromic pigment composition/wall film of from 7/1 to 1/1;

said thermochromic microcapsules being contained in an amount of from 0.5% to 40% by weight based on the weight of the acrylonitrile polymer, wherein said thermochromic acrylic is formed into fibers.

2. The thermochromic acrylic according to claim 1, wherein said thermochromic pigment composition is selected from any one of a heat-color-extinguishing type capable of color-extinguishing upon heating from a color-developed state and developing a color upon cooling from a color-extinguished state, a color-memorizing type capable of memorizing a color-developed state and a color-extinguished state alternately in a specific temperature region, and a heat-color-developing type capable of developing a color upon heating from a color-extinguished state and restoring to the color-extinguished state upon temperature drop from a color-developed state.

3. A processed article comprising a plurality of filaments of long fibers or short fibers of the thermochromic acrylic according to claim 2, having a single-fiber external diameter of from 1 $\mu$m to 100 $\mu$m; the filaments are in a bundled, close-contact or massed state.

4. The processed article according to claim 3, which is any of tow, a sliver, a cottony aggregate yarn, cloth, flocked fabric, raised fabric and papermaked fabric.

5. The processed article according to claim 4 which is a cloth, wherein said cloth is any of woven fabric, knitted fabric, nonwoven fabric and pile fabric.

6. The processed article according to any one of claims 3 to 5, which is a wig, a hairpiece or a dole's or animal toy's hair of the head, hair of bodies or outer garments comprising filament yarn, spun yarn, wool-yarn-like crimped yarn or pile fabric.

7. The processed article according to claim 5, which is a dole's or animal toy's cloth, outer garments or accessories comprising any of woven fabric, knitted fabric, nonwoven fabric and pile fabric.

8. The processed article according to any one of claims 3 to 5, which further comprises a non-thermochromic fiber blended in an amount of from 0.01 part by weight to 20 parts by weight based on 1 part by weight of the thermochromic acrylic synthetic fiber.

* * * * *

UNITED STATES PATENT AND TRADEMARK OFFICE

CERTIFICATE OF CORRECTION

PATENT NO. : 6,444,313 B1
DATED : September 3, 2002
INVENTOR(S) : Yoshiaki Ono et al.

It is certified that error appears in the above-identified patent and that said Letters Patent is hereby corrected as shown below:

Title page,
Item [56], References Cited, FOREIGN PATENT DOCUMENTS,
"62149907 7/1987" should read -- 62-149907 7/1987 --.

Column 2,
Line 57, "an" (second occurrence) should read -- a --.

Column 7,
Line 17, "of;" should read -- of: --.

Column 8,
Line 43, "can not" should read -- cannot --.

Column 14,
Line 67, "dole's" should read -- doll's --.

Column 15,
Line 5, "dole's" should read -- doll's --.

Signed and Sealed this

Twenty-second Day of April, 2003

JAMES E. ROGAN
*Director of the United States Patent and Trademark Office*